US006210206B1

(12) United States Patent
Durham

(10) Patent No.: US 6,210,206 B1
(45) Date of Patent: Apr. 3, 2001

(54) SAFETY SHIELD SPIKING TOOL AND METHOD FOR SPIKING HIGH VOLTAGE POWER LINES

(76) Inventor: Roland G. Durham, 1444 W. Plana, Mesa, AZ (US) 85202

( * ) Notice: Subject to any disclaimer, the term of this patent is extended or adjusted under 35 U.S.C. 154(b) by 0 days.

(21) Appl. No.: 09/366,386

(22) Filed: Aug. 3, 1999

(51) Int. Cl.[7] ..... H01R 4/24

(52) U.S. Cl. ..... 439/416; 439/479; 439/480; 324/66; 324/133

(58) Field of Search ..... 439/416, 803, 439/100, 477–480; 140/147, 113; 324/133, 66; 361/1

(56) References Cited

U.S. PATENT DOCUMENTS

| | | | | |
|---|---|---|---|---|
| 3,036,286 | * | 5/1962 | Gorc et al. | 439/480 |
| 3,363,310 | | 1/1968 | Stinson, Jr. | 29/857 |
| 3,574,644 | * | 4/1971 | Olstowski et al. | 106/15 |
| 3,594,703 | * | 7/1971 | Holtzapple | 439/416 |
| 3,869,361 | | 3/1975 | Jenkins | 204/108 |
| 4,660,909 | | 4/1987 | Wilson | 439/98 |
| 4,676,574 | * | 6/1987 | Grosso et al. | 439/271 |
| 4,817,682 | * | 4/1989 | Williams | 140/113 |
| 4,859,192 | | 8/1989 | DeLeo | 439/92 |
| 5,168,128 | * | 12/1992 | Thomsen | 439/447 |
| 5,367,251 | * | 11/1994 | McTigue | 439/480 |
| 5,666,253 | * | 9/1997 | Whited et al. | 361/1 |

* cited by examiner

*Primary Examiner*—Renee Luebke
*Assistant Examiner*—Briggitte R. Hammond
(74) *Attorney, Agent, or Firm*—John D. Lister

(57) ABSTRACT

A spiking tool for spiking high voltage underground power lines includes a safety shield to protect the operator of a shotgun stick from the flame and heat emitted when a hot power line is spiked. A first embodiment of the tool includes a tubular sleeve for encasing a length of power line. The tubular sleeve has a slot therein through which a power line can be introduced into and encased within the tubular sleeve and a spiking assembly with a grounded spike made of an electrically conductive material for penetrating the insulating casing of and making contact with wiring within a power line housed within the tubular sleeve. A second embodiment of the tool includes a shield plate mounted on and extending outward from the shaft of a shotgun stick intermediate a first end of the stick which engages a spiking clamp and a second end of the stick held by the tool operator. The shield plate is clear so that the tool operator can see a spiking clamp and power line through the shield and colored to reduce glare from a flame when a hot power line is spiked.

11 Claims, 3 Drawing Sheets

FIG. 1
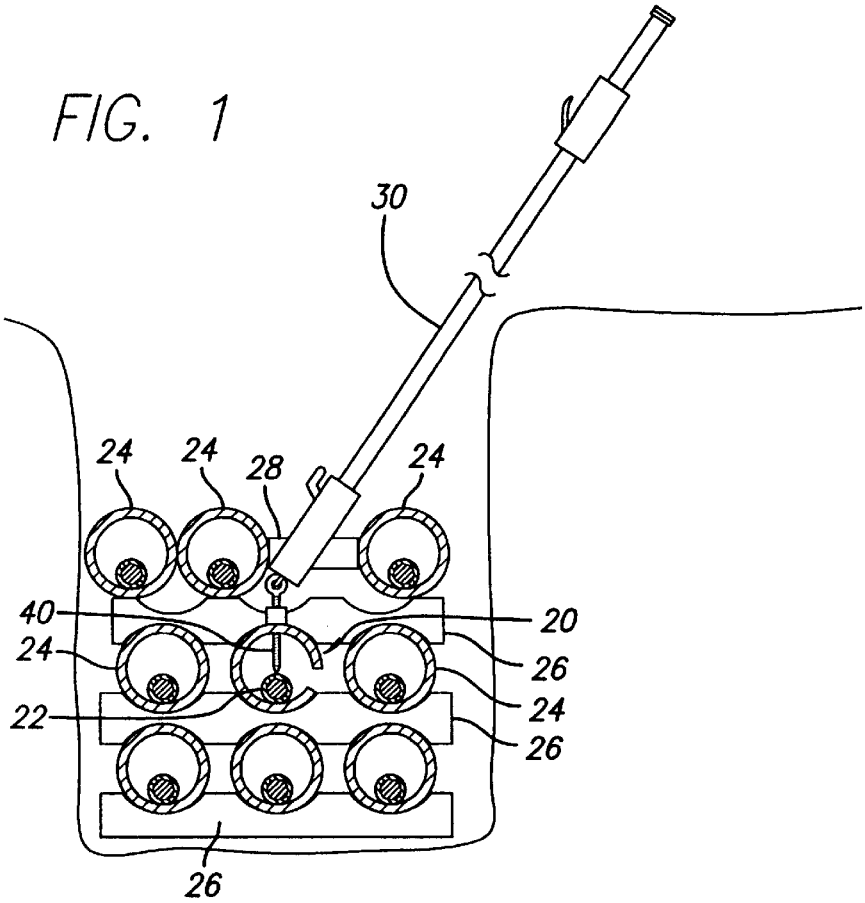
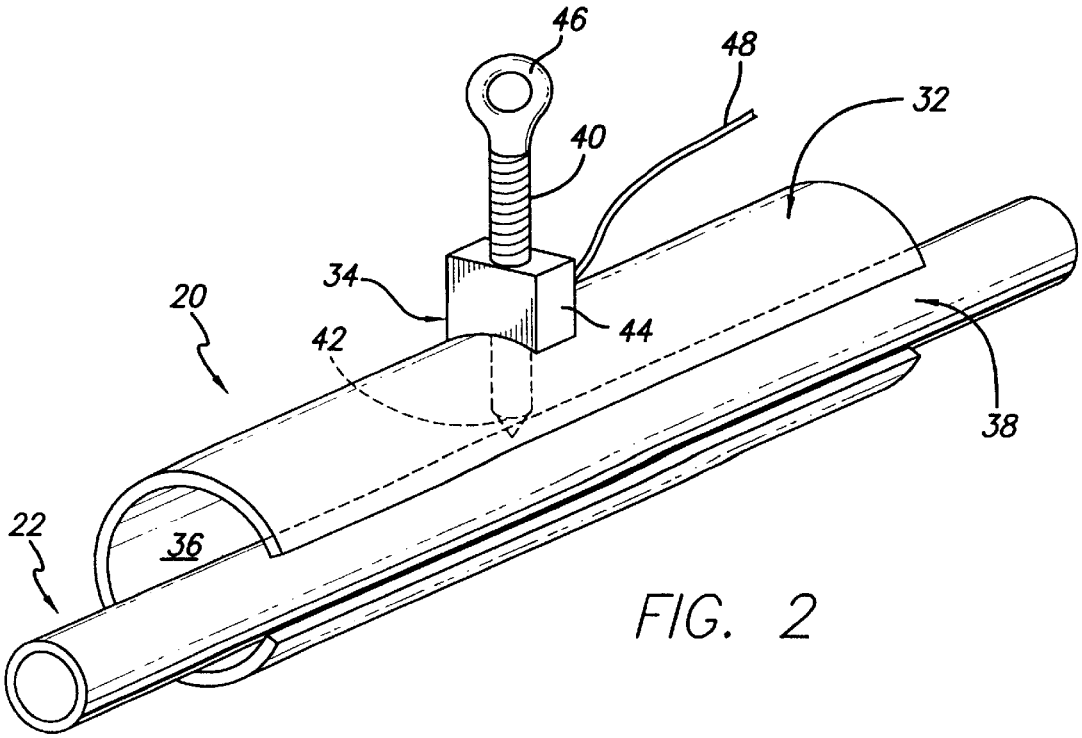
FIG. 2

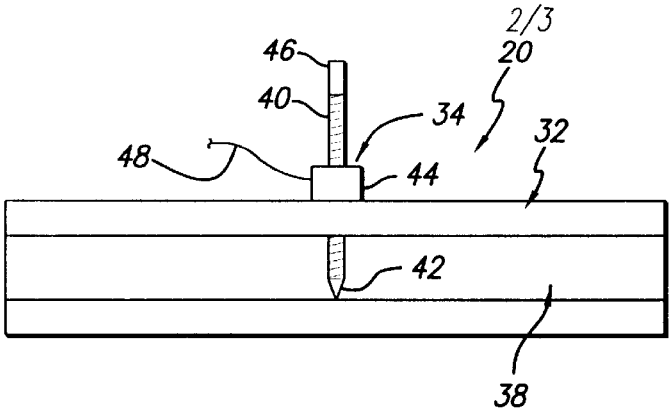
FIG. 3
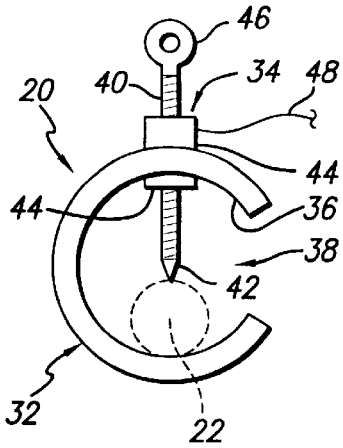
FIG. 4
FIG. 7
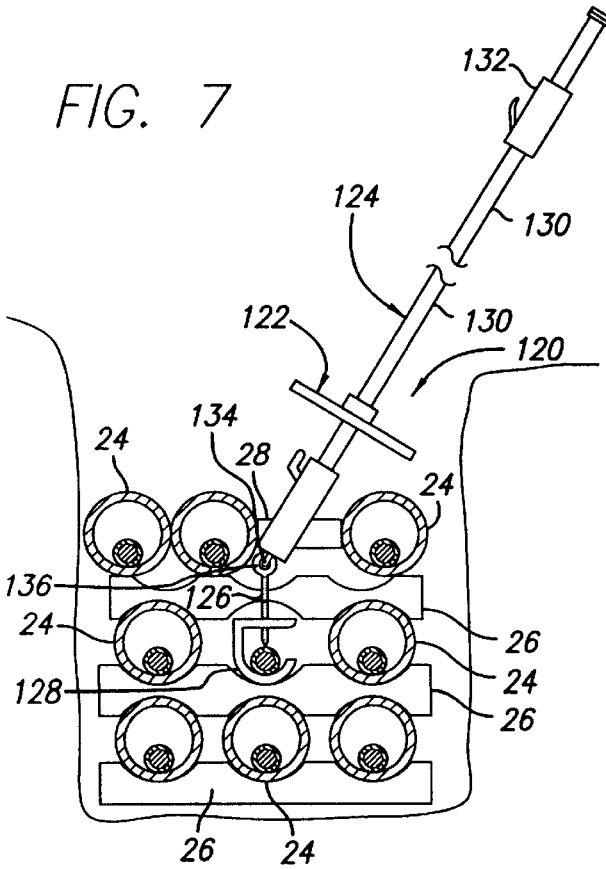
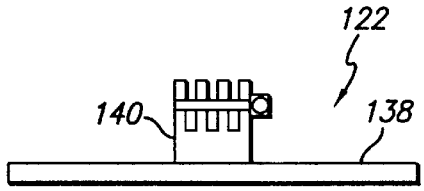
FIG. 8
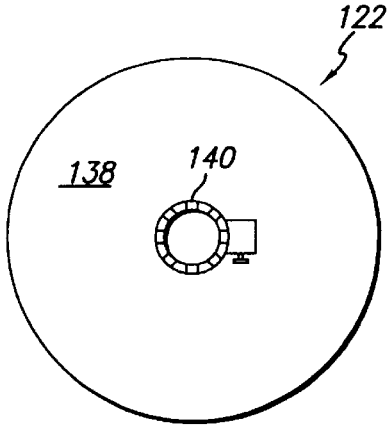
FIG. 9

SAFETY SHIELD SPIKING TOOL AND METHOD FOR SPIKING HIGH VOLTAGE POWER LINES

BACKGROUND OF THE INVENTION

The present invention relates to spiking tools for spiking underground power lines to determine if the power lines are hot and, in particular, to a spiking tool and method of spiking a power line which shields the spiking tool operator from the flame and heat emitted when a hot power line is spiked.

During the construction of shopping malls, industrial complexes, commercial buildings, and similar relatively large building projects, new or existing, buried or underground high voltage power lines have to be tapped into or spliced to provide electrical services to the project. Typically, there will be several different tubular conduits closely grouped together within the trench that each contain a different high voltage power line or cable. Once a length of one of the power lines to be tapped for the project has been exposed, by removing a section of one of the tubular conduits from about the power line, the power line must be checked to determine if the electrical power to the power line has actually been turned off prior to working with the power line to make the tap. Otherwise, if the electrical power to the power line has not been turned off, anyone working with the power line to make a tap would most likely be seriously injured if not killed.

Typically, the power line is tested to determine if the electrical power to the power line has been turned off by spiking the power line with a spiking clamp (such as, a spiking clamp made by Hastings of Hastings, Mich.). The spiking clamp has a threaded spike with a pointed end that is used to penetrate the insulating casing of the power line and make contact with the wiring within insulating casing of the power line. The threaded spike is grounded and an eye on the second end of the threaded spike is turned with a shotgun stick (such as, a shotgun stick sold by Hastings of Hastings, Mich.) to cause the spike to penetrate the insulating casing and make contact with the wiring within the insulating casing. If the power line is hot (the electrical power to the power line has not been turned off) the contact of the spike of the spiking clamp with the wiring of the power line normally causes an eruption of hot flame from the power line at the location of the spike. Although the use of a shotgun stick is intended to protect the workers when the spike makes contact with a hot line, the workers are not shielded by the spiking clamp or shotgun stick and the operator of the shotgun stick or other workers close by can be injured by the flame and heat caused by spiking the power line. Thus, although spiking clamps and shotgun sticks have been in use for many years, there has remained a need to protect the shotgun operator and other workers from the flame and heat of a spiking operation when the power line is hot.

SUMMARY OF THE INVENTION

The spiking tool of the present invention for spiking high voltage underground power lines includes a safety shield to protect the operator of a shotgun stick from the flame and heat emitted when a hot power line is spiked.

A first embodiment of the spiking tool of the present invention includes a tubular sleeve for encasing a length of power line and a spiking assembly. The tubular sleeve shields the operator from the flame and heat emitted when a hot power line is spiked. The tubular sleeve has: an internal diameter greater than an external diameter of a power line to be encased within the tubular sleeve for spiking; a longitudinally extending slot therein extending for the length of the tubular sleeve through which a power line can be introduced into the tubular sleeve; and, preferably, is fire resistant and high temperature resistant. The spiking assembly includes a spike, made of an electrically conductive material, with a pointed first end for penetrating the insulating casing of and making contact with wiring within a power line housed within the tubular sleeve. The spiking assembly also includes an assembly mount for mounting the spike on a central portion of the tubular sleeve with the spike passing through a sidewall of the tubular sleeve, the pointed first end of the spike located within the tubular sleeve, and the longitudinal axis of the spike out of alignment with the longitudinally extending slot of the tubular sleeve so that the power line is supported on and by the inside of the tubular sleeve when it is being spiked. The assembly mount also has a means for moving the spike to penetrate the insulating casing of and make contact with wiring within a power line housed within the tubular sleeve and an electrically conductive means for connecting the spike to a ground.

A second embodiment of the spiking tool of the present invention includes a shield which is mounted on a conventional shotgun stick that is used for turning the spike of a power line spiking assembly. As discussed above in the background of the invention, typically, a shotgun stick has an elongated shaft with a handle adjacent a first end to be held by a tool operator and a hook at a second end for engaging the eye of a spike of a spiking assembly. The shield has a plate, preferably a disk, extending perpendicular to a longitudinal axis of and outward from the elongated shaft of the shotgun stick for a radial distance sufficient to shield an operator of the shotgun stick from the flame and heat when a hot power line is spiked and is mounted on the elongated shaft of the shotgun stick intermediate the first and second ends of the shaft to protect a tool operator from heat and flame when a hot power line is spiked. The shield plate is clear so that the tool operator can see a spiking assembly and power line through the shield and colored to reduce the glare from a flame when a hot power line is spiked.

BRIEF DESCRIPTION OF THE DRAWINGS

FIG. 1 is a schematic cross section through a trench containing high voltage underground power lines to schematically illustrate the first embodiment of the shielded spiking tool of the present invention in use.

FIG. 2 is a schematic perspective view of the first embodiment of the shielded spiking tool of the present invention.

FIG. 3 is a schematic side view of the first embodiment of the shielded spiking tool of the present invention.

FIG. 4 is a schematic end view of the first embodiment of the shielded spiking tool of the present invention.

FIG. 7 is a schematic cross section through a trench containing high voltage underground power lines to schematically illustrate the second embodiment of the shielded spiking tool of the present invention in use.

FIG. 8 is a schematic side view of a shield of the spiking tool of the second embodiment of the present invention.

FIG. 9 is a schematic top or bottom view of the shield of FIG. 8.

DESCRIPTION OF THE PREFERRED EMBODIMENTS

Figure 5:
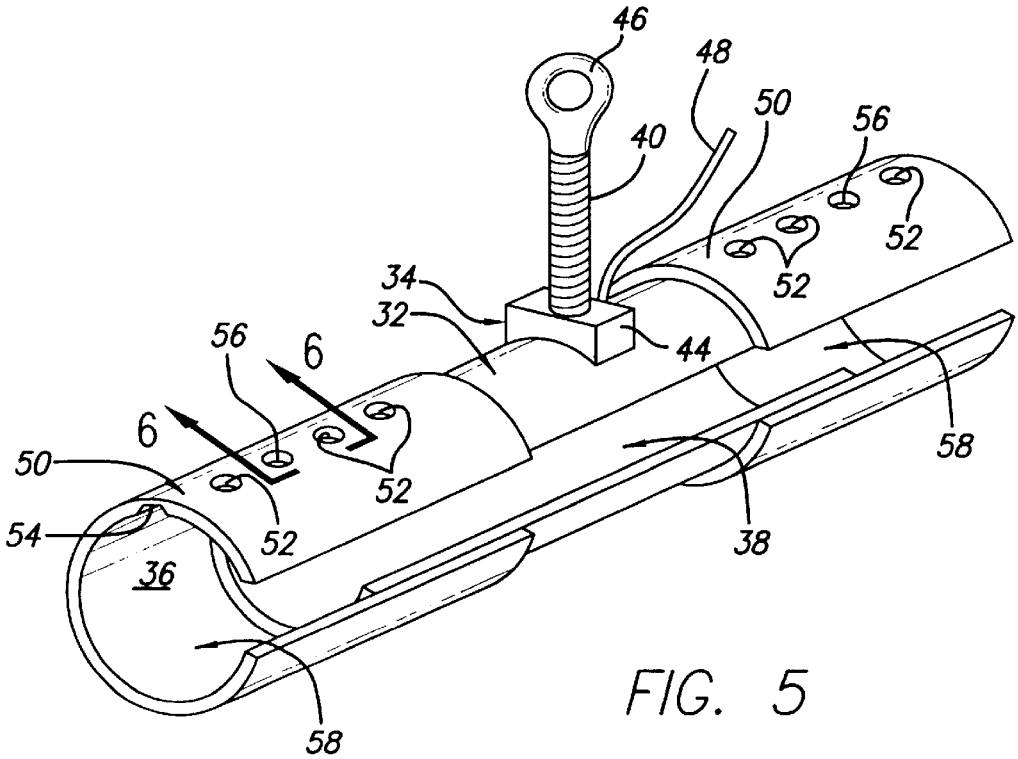
FIG. 5 is a schematic perspective view of the first embodiment of the shielded spiking tool of the present invention provided with tubular sleeve extensions for adjusting the length of the spiking tool shield.

FIG. 1 schematically shows a first embodiment 20 of the spiking tool of the present invention being used to spike an underground, high voltage power line 22. As shown, there is a grouping of nine different conduits 24, each containing a different high voltage power line 22, in a trench. Typically, the conduits 24 are positioned and supported on spacers 26, but are located in very close proximity to one another so that it can be quite difficult to work on a power line 22 in one of the conduits within the grouping of conduits. As shown, a high voltage power line 22 in a centrally located conduit is be spiked and to do that one or more blocks of wood or other spacers 28 have been used to spread apart two of the upper conduits 24 to gain access to the conduit and power line with the spiking tool 20 and a conventional shotgun stick 30, such as a Hastings shotgun stick sold by Hastings of Hastings, Mich. While the slot in the spiking tool 20 is shown opening to the right in the FIG. 1, the spiking tool can also be turned around so that the slot in the spiking tool would open to the left.

As shown in FIGS. 2–4, the first embodiment 20 of the spiking tool of the present invention includes a tubular sleeve 32 for encasing a length of power line 22 and a spiking assembly 34. The tubular sleeve 32 has a length sufficient to shield the operator from the flame and heat emitted when a hot power line 22 is spiked and is, typically, between about 8 inches and about 38 inches long, preferably, between about 14 inches and about 18 inches long. The tubular sleeve 32 can be made of either a conductive or nonconductive material, such as but not limited to, a glass fiber reinforced plastic, an ABS plastic, stainless steel or aluminum, and may be resilient. Preferably, the tubular sleeve 32 is made of a fire and heat resistant, non-conductive material and/or the internal surface of the tubular sleeve 32 is coated, coating 36, with a commercially available, fire resistant and/or retardant, high temperature resistant material, such as but not limited to, commercially available silica containing coatings or commercially available coatings containing heat expandable graphite flakes such as coatings disclosed in U.S. Pat. No. 3,574,644. Where a conductive material is used for the tubular sleeve, preferably, the interior surface of the sleeve is coated with a non-conductive material. While the tubular sleeve 32 preferably is a slotted, elongated hollow cylinder with a circular cross section, the tubular sleeve can be a slotted elongated sleeve having a cross section other than circular, such as but not limited to a flat oval, square or rectangular cross section.

The power lines or primary wires 22 spiked are typically about 1 inch to about 5 inches or greater in diameter. The tubular sleeve 32 has an internal diameter greater than the external diameter of a power line 22 to be encased within the tubular sleeve for spiking.

The tubular sleeve 32 has a longitudinally extending slot 38 therein, extending for the entire length of the tubular sleeve 32, through which a power line 22 can be introduced into the tubular sleeve. The longitudinally extending slot 38 normally has a width greater than the external diameter of the power line 22 to be encased within the tubular sleeve 32 so that a length of the power line can be easily introduced into the tubular sleeve 32. However, when the tubular sleeve 32 is made of a resilient material, the width of the slot 38 can be less than the external diameter of the power line 22 to be encased within the tubular sleeve 32 and the lateral edges of the slot 38 can be spread apart to permit the passage of the power line through the slot and into the tubular sleeve. After the power line 22 has been passed through the slot 38, the resilience of the tubular sleeve 32 will again reduce the width of the slot 38 to more completely encase the power line 22 within the tubular sleeve.

The spiking assembly 34 of the spiking tool 20 includes a spike 40, made of an electrically conductive material, such as but not limited to aluminum. The spike 40 has a pointed first end 42 for penetrating the insulating casing of and making contact with wiring within a power line 22 housed within the tubular sleeve 32. The spiking assembly 34 also includes an assembly mount 44 for mounting the spike 40 on a central portion of the tubular sleeve 32 (preferably midway between the ends of the tubular sleeve) with the spike 40 passing through a sidewall of the tubular sleeve, the pointed first end 42 of the spike located within the tubular sleeve, and the longitudinal axis of the spike 40 out of alignment with the longitudinally extending slot 38 of the tubular sleeve so that the power line 22 is supported on and by the inside of the tubular sleeve 32 when it is being spiked. The assembly mount 44 also has a means for moving the spike 40 in the direction of its longitudinal axis to penetrate the insulating casing of and make contact with wiring within a power line 22 housed within the tubular sleeve. In a preferred form of the invention, the spike 40 and the assembly mount 44 are both threaded and the spike 40 is provided with an eye 46 at its second end by which the spike 40 can be turned in the assembly mount 44 to move the spike 40 in or out in the direction of its longitudinal axis. The spiking assembly 34 also includes an electrically conductive means 48, e.g. a cable typically about 8 feet long connected to the assembly mount 44 at one end and to a grounding rod at the other end, for connecting the spike 40 to a ground.

Figure 6:
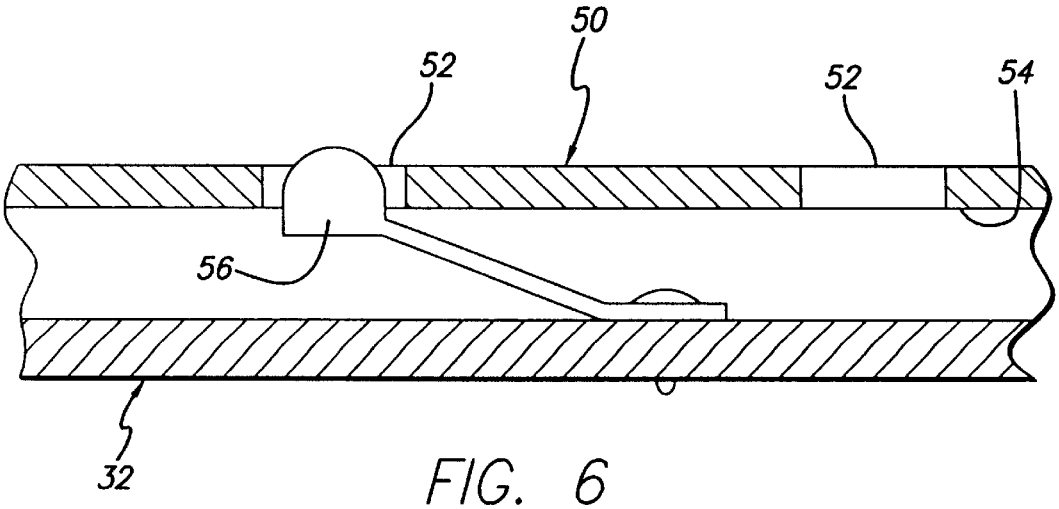
FIG. 6 is a schematic cross section taken substantially along lines 6—6 of FIG. 5 to illustrate one form of latching system for securing the tubular sleeve extensions to the main tubular sleeve.

FIGS. 5 and 6 show the spiking tool 20 provided with a pair of tubular sleeve extensions 50 which are slidably mounted on the tubular sleeve 32 and can be used to adjust the length of the tubular sleeve shield encasing a power line 22. As shown, each of the tubular sleeve extensions 50 is provided with a series of longitudinally aligned holes 52 which are centered over a longitudinally extending groove 54 in the interior surface of the tubular sleeve extension. A spring loaded push button 56 is secured to the tubular sleeve 32 at a location spaced inwardly from but near each end of the tubular sleeve 32. The spring loaded push buttons 56 are received within the grooves 54 of the tubular sleeve extensions 50 and as the sleeve extensions are slid relative to the tubular sleeve 32, the push buttons 56 pop into the holes 52 that are aligned with the push buttons to secure the extensions in place relative to the tubular sleeve 32. To adjust an extension 50 in or out, the operator merely has to depress the push button 56 out of a hole 52, slide the extension in or out, and let the spring loaded push button pop into another hole 52 when the extension is located where the operator wants the extension to get the desired tubular sleeve shield length. With the push buttons 56 located within the grooves 54, the slots 58 in the tubular sleeve extensions are properly aligned with the slot 38 in the tubular sleeve 32 so that a power line 22 can be passed through the slot 38 and slots 58 into the tubular sleeve 32 and the tubular sleeve extensions 50. While two tubular sleeve extensions 50 are shown, one or two tubular sleeve extensions can be used. The number of holes 52, the spacing of the holes 52 and the lengths of the tubular sleeve extensions 50 can vary as required. In addition, a latching means other than the spring loaded push buttons 56 can also be used to locate and retain the tubular sleeve extensions relative to the tubular sleeve 32.

The method of using spiking tool 20 to spike a high voltage, underground power line 22 includes: removing a section of a conduit 24 to expose a length of a power line 22; passing the length of power line 22 through the longitudinal slot 38 of the tubular sleeve 32 so that the length of power line 22 is encased within the tubular sleeve 32; centering the length of power line 22 beneath the spike 40 of the spiking assembly 34; grounding the spiking assembly; connecting the shotgun stick 30 to the eye 46 of the spike 40; and turning the spike 40 with the shotgun stick 30 to drive the pointed first end 42 of the spike 40 through the insulating casing of the power line and into contact with wiring within the power line to determine if the power line is hot.

FIG. 7 schematically shows a second embodiment 120 of the spiking tool of the present invention being used to spike an underground, high voltage power line 22. As shown, there is a grouping of nine different conduits 24, each containing a different high voltage power line 22, in a trench. As discussed above in connection with the first embodiment, typically, the conduits 24 are positioned and supported on spacers 26, but are located in very close proximity to one another so that it can be quite difficult to work on a power line 22 in one of the conduits within the grouping of conduits. As shown, a high voltage power line 22 in a centrally located conduit is be spiked and to do that one or more blocks of wood or other spacers 28 have been used to spread apart two of the upper conduits 24 to gain access to the conduit and power line with the spiking tool 20 and a conventional shotgun stick 124, such as but not limited to a Hastings shotgun stick sold by Hastings of Hastings, Mich.

As shown in FIGS. 7–9, the second embodiment 120 of the spiking tool of the present invention includes a shield 122 which is mounted on a conventional shotgun stick 124 that is used for turning the spike 126 of a grounded power line spiking clamp 128. The shotgun stick 124 has an elongated shaft 130, e.g. about 6 feet to about 8 feet long, with a handle 132 adjacent a first end to be held by a tool operator and a hook 134 at a second end for engaging the eye 136 of the spike 126 of the spiking clamp 128. The shield 122 has a plate 138, preferably a disk about ¼ inch in thickness made of epoxyglass, a plastic (preferably heat resistant) or a similar material, extending perpendicular to a longitudinal axis of and outward from the elongated shaft 130 of the shotgun stick 124 a distance sufficient to shield the tool operator from the flame and heat emitted when a hot power line is spiked, e.g. typically, a radial distance of about 5 to about 8 inches or greater from the circumferential surface of the shaft and for certain applications a radial distance of about 12 inches or greater from the circumferential surface of the shaft of the shotgun stick 124. The shield 122 has a collar 140 which can be tightened about the shaft 130 of the shotgun stick 124 and is mounted on the elongated shaft 130 of the shotgun stick intermediate the first and second ends of the shaft (preferably, adjacent the second end of the shaft near the spiking clamp) to protect a tool operator from heat and flame when a hot power line is spiked. The shield plate 122 is clear so that the tool operator can see a spiking clamp 128 and power line 22 through the shield plate and colored, e.g. a smoky clear, to reduce the glare from a flame when a hot power line is spiked.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A shielding spiking tool for spiking high voltage power lines to determine if the power lines are hot, comprising:

a tubular sleeve for encasing a length of power line; the tubular sleeve having a length between eight inches and thirty eight inches to shield an operator of the spiking tool from flame and heat when a hot power line is spiked and an internal diameter greater than an external diameter of a power line to be encased within the tubular sleeve for spiking; the tubular sleeve having a longitudinally extending slot therein extending for the length of the tubular sleeve through which a power line having an external diameter less than the internal diameter of the tubular sleeve can be introduced into the tubular sleeve; and a spiking assembly, the spiking assembly including a spike made of an electrically conductive material; the spike having a longitudinal axis and a pointed first end for penetrating the insulating casing of and making contact with wiring within a power line housed within the tubular sleeve; the spiking assembly including a mounting means mounting the spike on a central portion of the tubular sleeve located midway between ends of the tubular sleeve with the spike passing through a sidewall of the tubular sleeve, the pointed first end of the spike located within the tubular sleeve, and the longitudinal axis of the spike out of alignment with the longitudinally extending slot of the tubular sleeve; means for moving the spike in the direction of the longitudinal axis of the spike to penetrate the insulating casing of and make contact with wiring within a power line housed within the tubular sleeve; and the spiking assembly including electrically conductive means for connecting the spike to a ground.

2. The shielding spiking tool for spiking high voltage power lines according to claim 1, wherein:

the longitudinally extending slot has a width greater than the external diameter of a power line to be encased with the tubular sleeve.

3. The shielding spiking tool for spiking high voltage power lines according to claim 1, wherein:

the longitudinally extending slot has a width less than the external diameter of a power line to be encased with the tubular sleeve and the tubular sleeve is made of a resilient material which permits lateral edges of the longitudinally extending slot to be spread apart to receive a power line.

4. The shielded spiking tool for spiking high voltage power lines according to claim 1, wherein:

the tubular sleeve is fire resistant and non-conductive.

5. The shielded spiking tool for spiking high voltage power lines according to claim 1, wherein:

the tubular sleeve has a fire resistant coating covering an interior surface of the tubular sleeve.

6. The shielded spiking tool for spiking high voltage power lines according to claim 1, wherein:

the spike has a threaded shaft which is threadably received within a collar of the mounting means and an eye at a second end of the spike for engagement by a shotgun stick to turn the spike and move the spike in the direction of the longitudinal axis of the spike.

7. The shielding spiking tool for spiking high voltage power lines according to claim 1, wherein:

the tubular sleeve is fire resistant; and the spike has a threaded shaft which is threadably received within a collar of the mounting means and an eye at a second end of the spike for engagement by a shotgun stick to turn the spike and move the spike in the direction of the longitudinal axis of the spike.

8. A shielded spiking tool for spiking high voltage power lines to determine if the power lines are hot, comprising:

a tubular sleeve for encasing a length of power line; the tubular sleeve having a length sufficient to shield an operator of the spiking tool from flame and heat when a hot power line is spiked and an internal diameter greater than an external diameter of a power line to be encased within the tubular sleeve for spiking; the sleeve having a longitudinally extending slot therein extending for the length of the tubular sleeve through which a power line having an external diameter less than the internal diameter of the tubular sleeve can be introduced into the tubular sleeve;

a first tubular sleeve extension slidably mounted on a first end of the tubular sleeve; and the first tubular sleeve extension having a longitudinally extending slot therein which is aligned with the longitudinally extending slot in the tubular sleeve through which a power line having an external diameter less than the internal diameter of the tubular sleeve can be introduced into the tubular sleeve and the tubular sleeve extension; and a spiking assembly, the spiking assembly including a spike made of an electrically conductive material; the spike having a longitudinal axis and a pointed first end for penetrating the insulating casing of and making contact with wiring within a power line housed within the tubular sleeve; the spiking assembly including a mounting means mounting the spike on a central portion of the tubular sleeve with the spike passing through a sidewall of the tubular sleeve, the pointed first end of the spike located within the tubular sleeve, and the longitudinal axis of the spike out of alignment with the longitudinally extending slot of the tubular sleeve; means for moving the spike in the direction of the longitudinal axis of the spike to penetrate the insulating casing of and make contact with wiring within a power line housed within the tubular sleeve; and the spiking assembly including electrically conductive means for connecting the spike to a ground.

9. The shielded spiking tool for spiking high voltage power lines according to claim 8, including:

a second tubular sleeve extension slidably mounted on a second end of the tubular sleeve; and the second tubular sleeve extension having a longitudinally extending slot therein which is aligned with the longitudinally extending slot in the tubular sleeve through which a power line having an external diameter less than the internal diameter of the tubular sleeve can be introduced into the tubular sleeve and the tubular sleeve extension.

10. A method of spiking a high voltage power line to determine if the power line is hot, comprising:

exposing a length of a power line;

providing a shielding spiking tool having a tubular sleeve for encasing a length of power line; the tubular sleeve having a length between about eight inches and about thirty eight inches to shield an operator of the spiking tool from fire and heat when a hot power line is spiked and an internal diameter greater than an external diameter of the power line; the sleeve having a longitudinally extending slot therein extending for the length of the tubular sleeve through which the power line can be introduced into the tubular sleeve; the spiking tool including a spiking assembly, the spiking assembly including a spike made of an electrically conductive material; the spike having a longitudinal axis and a pointed first end for penetrating the insulating casing of and making contact with wiring within the power line; the spiking assembly including a mounting means mounting the spike on a central portion of the tubular sleeve located midway between ends of the tubular sleeve with the spike passing through a sidewall of the tubular sleeve, the pointed first end of the spike located within the tubular sleeve, and the longitudinal axis of the spike out of alignment with the longitudinally extending slot of the tubular sleeve; the spiking assembly including means for moving the spike in the direction of the longitudinal axis of the spike to penetrate the insulating casing of and make contact with wiring within the power line; and the spiking assembly including electrically conductive means for connecting the spike to a ground;

passing a portion of the power line through the slot in the tubular sleeve of the spiking tool to encase the power line within the tubular sleeve of the spiking tool; and moving the spike in the direction of the longitudinal axis of the spiking tool and penetrating the casing of and making contact with the wiring within the power line to determine if the power line is hot.

11. The method for spiking high voltage power lines according to claim 10, wherein:

the spike has a threaded shaft which is threadably received within a collar of the mounting means and an eye at a second end of the spike for engagement by a shotgun stick to turn the spike and move the spike in the direction of the longitudinal axis of the spike; and the spike is turned with a shotgun stick.

* * * * *